United States Patent [19]

Rouse

[11] Patent Number: 4,888,972

[45] Date of Patent: Dec. 26, 1989

[54] PROCESS AND APPARATUS FOR THE MANUFACTURE OF RADIATOR COOLING FINS

[75] Inventor: Jack Rouse, Pickering, Canada

[73] Assignee: Pronto Auto Repair Dealerships Inc., Pickering, Canada

[21] Appl. No.: 214,321

[22] Filed: Jul. 1, 1988

[51] Int. Cl.[4] ..... B21D 13/04

[52] U.S. Cl. ..... 72/186; 72/187

[58] Field of Search ..... 72/185, 186, 187, 195, 72/449; 74/405, 406

[56] References Cited

U.S. PATENT DOCUMENTS

| | | | |
|---|---|---|---|
| Re. 22,956 | 2/1942 | Salzer . | |
| 1,515,358 | 11/1924 | Page | 72/187 |
| 1,937,466 | 6/1932 | Smith et al. . | |
| 2,536,102 | 1/1951 | Smith . | |
| 3,318,128 | 4/1964 | Rhodes . | |
| 3,766,873 | 4/1971 | Narog . | |
| 4,291,560 | 9/1981 | Horwitt | 72/186 |

*Primary Examiner*—Lowell A. Larson

*Attorney, Agent, or Firm*—Basile and Hanlon

[57] ABSTRACT

Apparatus for corrugating a length of strip metal to form a series of zig-zag folds in the strip has counter rotating forming dies for forming a series of equally spaced apart impressions in the strip and counter rotating corrugating dies for forming the zig-zag folds in the strip intermediate adjacent impressions. The apparatus includes a clutch for selectively disengaging the drive for the corrugating dies to permit adjustment in the phase relationship of the rotation of the corrugating dies relative to the forming dies while the apparatus is in operation. This permits adjustment while the machine is operating to compensate for variations in physical characteristics of the material feed.

6 Claims, 3 Drawing Sheets

PROCESS AND APPARATUS FOR THE MANUFACTURE OF RADIATOR COOLING FINS

FIELD OF THE INVENTION

This invention relates to apparatus for corrugating a length of malleable metallic strip to form a series of zig-zag folds in the strip.

BACKGROUND OF THE INVENTION

A variety of machines are available for deforming strips of malleable metal into corrugated strips. The strips may have a variety of uses which include cooling fins for use in heat exchangers and the like. U.S. Pat. No. 1,937,466 discloses a representative type of machine for forming zig-zag folds in a strip of sheet metal which may be of copper or the like. Such corrugated strips may be used as cooling fins in sections of refrigerator condensers, radiator cores and the like. The machine is adapted to compensate for variations in the characteristics of the feed material. For example, one of the crimping rollers may be spring loaded to permit slight upward movement of one crimping roller relative to the other to compensate for variations in the malleability of the feed strip.

U.S. Pat. Nos. RE22,956 and 3,318,128 disclose other types of machines for manufacturing radiator fin material. Although both machines disclosed in these patents are capable of manufacturing fin stock, neither machine provides for ready adjustment in the phase relationship of the rotation of the impression dies relative to the folding dies. Hence it is difficult with these machines to compensate for variations in the characteristic of the toughness of the feed stock.

U.S. Pat. No. 3,766,873 specifically addresses the issue of varying the phase relationship of the impression dies relative to the folding dies by providing a floating idler gear in the gear transmission system which may be lifted from the transmission to provide for adjustment in the phase relationship of a rotation of the counter rotating impression dies relative to the counter rotating folding or corrugating dies. However, the provision of the floating idler gear which must be lifted up during operation of the machine does not lend itself to precise adjustment. Furthermore, the machine must be slowed to a very low rpm to permit such adjustment which moves the machine out of the normal operating realm and hence the adjustment may not always be consistent with the machine operating at full rpm. Furthermore with the toothed arrangement of the idler gear, a minor adjustment cannot be made because the extent of adjustment is determined by the number of teeth on the idler gear and the drive gears.

U.S. Pat. No. 2,536,102 discloses a phase relationship adjustor for two drive shafts. The axial position of an intermediate gear is varied to adjust the phase relationship of the two drive shafts. However, this system is somewhat complicated and would be of very expensive construction for use in varying the phase relationship of the forming dies relative to the folding dies.

SUMMARY OF THE INVENTION

In accordance with an aspect of this invention, an apparatus for corrugating a length of malleable metallic strip into a corrugated strip of a series of zig-zag folds includes opposing counter rotating forming dies for forming a series of equally spaced apart impressions in the strip. Means is provided for corrugating the strip with the impressions formed therein by folding the strip intermediate adjacent impressions in alternating opposing folds to form a series of zig-zag folds. The corrugating means comprises opposing counter rotating corrugating dies having opposing radially extending teeth. Means for driving the counter rotating forming dies in synchronism with each other and means for driving the counter rotating corrugating dies in synchronism with each other are provided. Means is provided for rotating the forming die drive means and as well as means for transmitting rotary motion from the forming die drive means to the corrugating drive means. The transmission means has an effective gear ratio to synchronize rotation of the corrugating dies in phase with the forming dies to induce zig-zag folding in the strip of metal between the formed adjacent impressions. The transmission means includes means for adjusting phase relationship of the rotation of the corrugating dies with rotation of the forming dies.

The improvement in the means for adjusting phase relationship comprises a slip clutch for selectively disengaging the transmission means while the rotating means continues to rotate the forming die drive means. To adjust the phase relationship of the counter rotating corrugating dies relative to the counter rotating forming dies, the slip clutch is continuously engaged with sufficient drive force to drive the counter rotating corrugating dies in a metal strip feed direction. Manually operable means is provided for overcoming the drive force to advance rotation of the corrugating die drive means in the feed direction. As the clutch slips by engaging the manually operable means, the phase relationship of the rotation of the counter rotating corrugating dies relative to the rotation of the counter rotating forming dies is adjusted thereby on an infinite basis.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
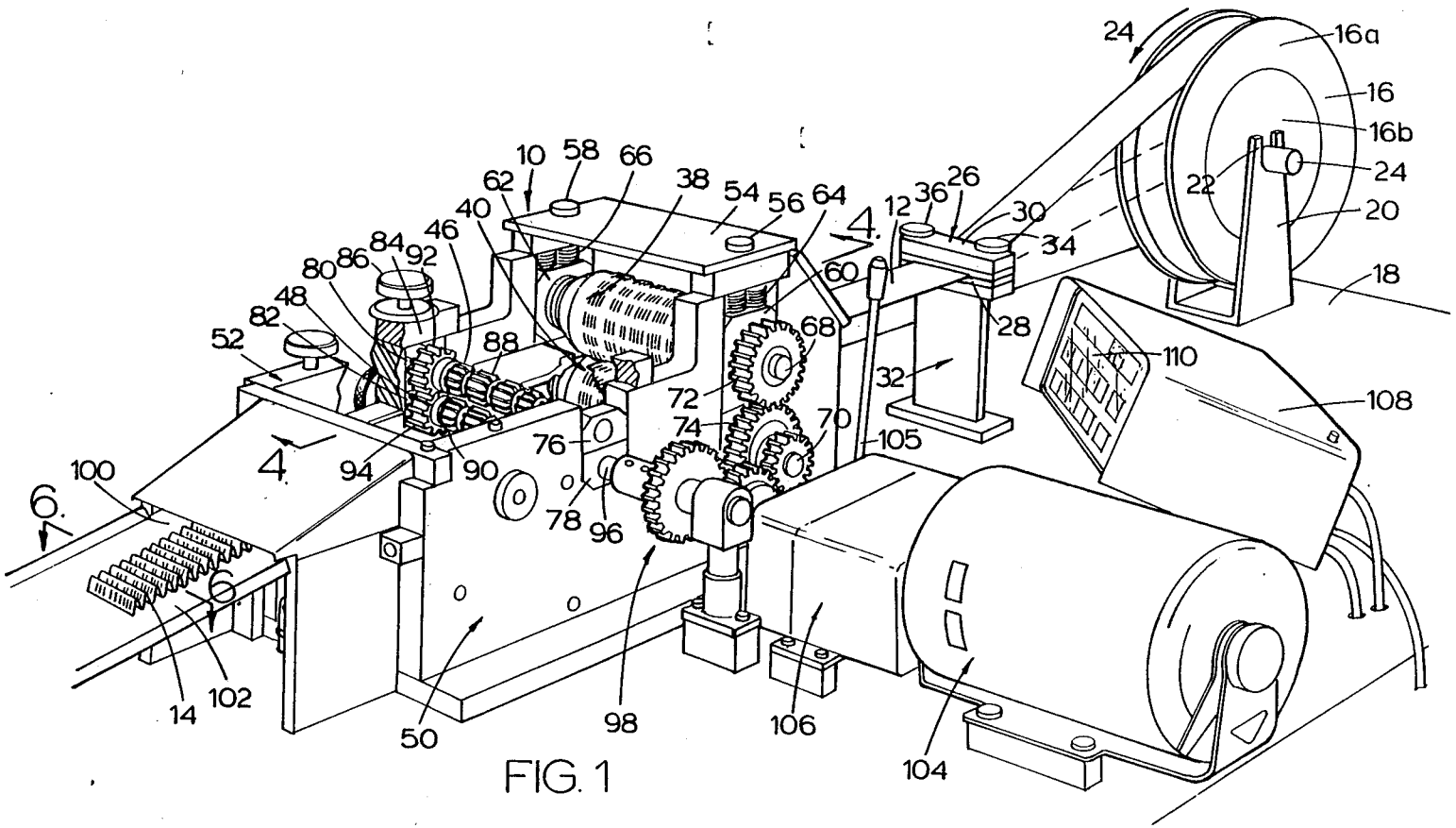
FIG. 1 is a perspective view of the apparatus according to a preferred embodiment of this invention.

The apparatus 10 takes in a metal strip 12 which is essentially of flat stock and corrugates it to form a corrugated strip 14 of a series of zig-zag folds. As previously mentioned, the corrugated strip can be put to a variety of uses such as, cooling fins in heat exchange devices, refrigerator condensers and evaporators and in radiator cores for the automotive industry. The apparatus 10 may be used in a normal day's production to manufacture sufficient quantities of corrugated strip 14 to supply sufficient cores for 30 or more automotive radiators. Hence the apparatus has to be able to function on an essentially continuous basis except for replacement of stock supply rolls throughout a standard eight hour shift. Aside from breakage of components in the apparatus 10 it is imperative to be able to adjust the operation of the apparatus while it is running, that is "on the fly". One difficulty that is encountered in the continuous operation of the apparatus 10, except for the down time to replace the supply of strip 12, is the fact that the physical characteristics of the strip 12 may vary over time. Normally, the strip 12 is removed from a supply roll 16 having the strip wound thereon from a full position at 16A to a depleted position designated 16B.

It is common practice to heat treat the metal strip prior to use in forming corrugated material. The heat treating is done to impart desirable physical characteristics in the material to provide sufficient temper and retain the malleable characteristics. For example, copper alloys are commonly used in forming corrugated strip material for use in forming radiator fins. In heat treating the copper alloy as wound on the drum 16, the outer wraps of copper alloy are heat treated to a different extent than the inner wraps of the copper alloy. Hence the characteristics of the copper alloy vary from the outer to the inner including a variation in the malleability of the material In running the apparatus 10 it is important to be able to compensate for this variation in the characteristics of the feed material as it is being pulled off of the drum 16. In apparatus which cannot provide for this adjustment it is quite common to discard several hundred feet of the inner material on the drum 16 because of the inability to adjust on the fly the operation of the apparatus 10. According to this invention, however, on the fly adjustments at operating speeds can be made to the operation of the apparatus 10 to compensate for variations in the toughness of the feed stock to ensure that the quality of the corrugated fins in providing consistent zig-zag folds in the material 14 is maintained. As a result the operator can improve the overall efficiency of the system to increase the production of the number of radiator cores per day.

The apparatus 10 may be mounted on a suitable steel plate table top 18. The supply spool of malleable strip 12 may be mounted on standards 20 having a yoke 22 to support the spool axle 24 and provide for free rotation in the direction of arrow 24. The strip material is fed through a guide 26 having opposing plate portions 28 and 30. Plate portion 28 is mounted on standard 32 which in turn is secured to the base plate !8. Opposing plates 28 and 30 are secured by spring loaded adjustable bolts 34 and 36. The compression force between the plates 28 and 30 may be varied to adjust the frictional drag on the strip 12 to ensure constant feed of the strip 12 to the apparatus 10.

Figure 6:
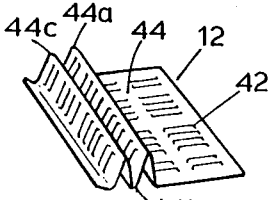
FIG. 6 is a view along the lines 6—6 of FIG. 1.

The apparatus 10 performs two working functions on the strip 12 to form the corrugated strip 14. Firstly, the strip 12 is passed between counter rotating forming dies generally designated 38 and 40. The purpose of the forming dies is to form an impression in the strip 12 of a relatively consistent length dimension where spacing between each impression is provided. With reference to FIG. 6, the strip 12 has a set of impressions 42 formed therein where along the length direction of the strip 12 adjacent impressions 42 are separated by an intermediate blank section 44. When the strip is used in forming radiator fin material the impressions 42 may be in the form of open slots or louvers as is the common standard in the radiator fin field and as exemplified in the above noted U.S. Pat. No. 3,318,128.

After the series of impressions are formed in the strip, the strip is then passed through opposing corrugating rollers generally designated 46 and 48. The purpose of the counter rotating corrugating rollers 46 and 48 is to form the zig-zag folds in the strip 12 at the intermediate blank portions 44 to the extent as exemplified in FIG. 6 The corrugating rollers 46 and 48 are synchronized with the operation of the forming dies 38 and 40 to fold the strip 12 at the intermediate portions to form a first fold 44A and a second fold 44B in the alternate opposing direction, and the next fold 44C so that as a result a plurality of alternating opposing folds are formed to provide a series of zig-zag folds in making the corrugated strip. It is very important that the operation of the corrugating dies 46 and 48 be timed in relation to the operation of the forming dies 38 and 40 so that the folds are formed in the blank regions 44. Should the timing of the counter rotating opposing corrugating dies 46 and 48 move out of synchronism with that of the forming dies 38 and 40, the folding action can take place closer to the impression portion 42 or even infringe on the impression 42. In this event the folds become irregular, hence producing inferior if not totally unacceptable radiator fin product.

According to this invention, a mechanism is provided which is manually adjustable during normal operating speeds of the machine to ensure that the counter rotating corrugating dies 46 and 48 are kept in timed relationship to the counter rotating forming dies 38 and 40 to always turn out a quality product. The most common factor which indirectly causes a variation in the timing of the corrugating dies relative to the forming des is the fact that the physical characteristics of the supply strip 12 vary over time due to the technic of heat treatment As well the thickness of the supply material can also have effect on the formation of the folds in the material relative to where the louvers 42 have been formed in the strip by the forming dies 38 and 40.

The apparatus 10 according to this embodiment has spaced apart frame members 50 and 52 in the form of plate portions The forming dies 38 and 40 have their axles journalled in the spaced apart plate 50 and 52. A shield 54 is mounted on the spaced apart frame members by bolts 56 and 58 above the forming dies 38 and 40. The upper forming die 38 according to this embodiment is mounted in slide blocks 60 and 62 which are spring loaded at the top by springs 64 and 66 to provide a slight degree of vertical motion in the upper die 38 relative to the lower die 40 to compensate for jams or the like between the dies. Externally of plate 50, the shafts 68 and 70 of the upper and lower dies 38 and 40 extend. Keyed to shaft 68 is gear 72, while keyed to shaft 70 is intermeshing gear 74. According to this embodiment gears 72 and 74 constitute the drive means for rotating in synchronism with each other the upper and lower forming dies 38 and 40.

The counter rotating corrugating dies 46 and 48 are mounted in slide blocks 76 and 78 in plate 50 and in slide blocks 80 and 82 in plate 52 The slide blocks are clamped in place by cap plate 84 with adjustment screw 86 which sets the relative spacing and meshing of the forming teeth 88 and 90 of the opposing dies 46 and 48. The corrugating dies 46 and 48 are provided at each end with intermeshing gears 92 and 94. The shaft 96 of the lower corrugating die 48 extends outwardly of the lower slide block 78. Through the transmission mechanism generally designated 98, the shaft 96 is driven. The rotary motion of the lower die 48 is transferred to the upper die 46 through the engagement of the gears 92 and 94.

Figure 2:
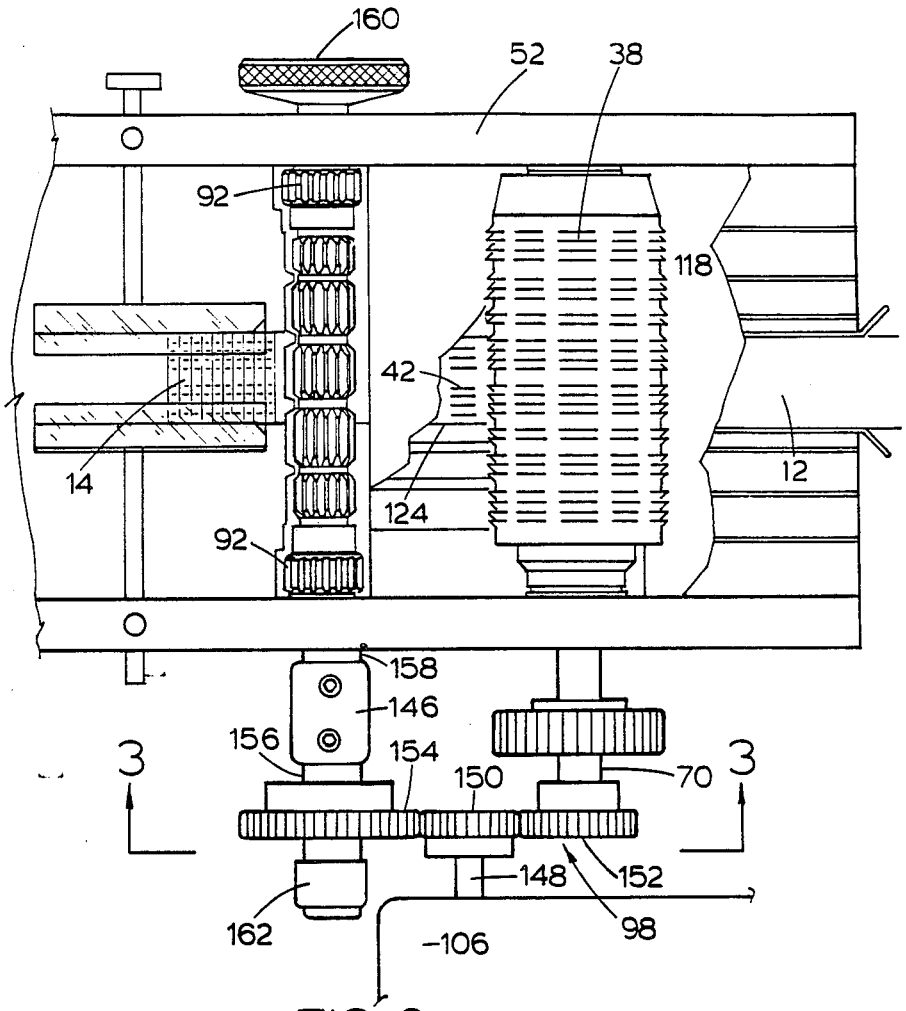
FIG. 2 is a top plan view of the forming dies and folding dies of, the apparatus of FIG. 1.
Figure 3:
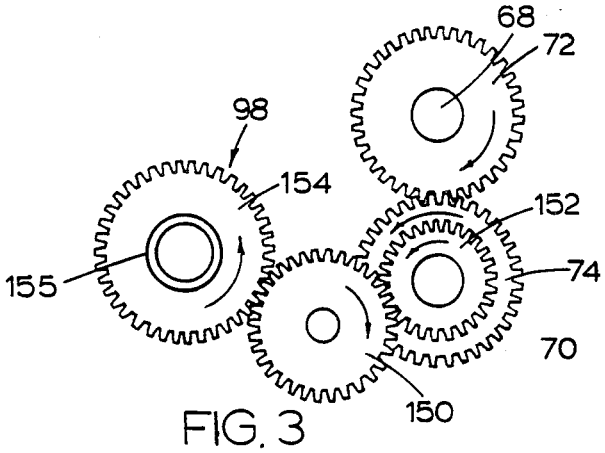
FIG. 3 is a view along the lines 3—3 of FIG. 2.
Figure 4:
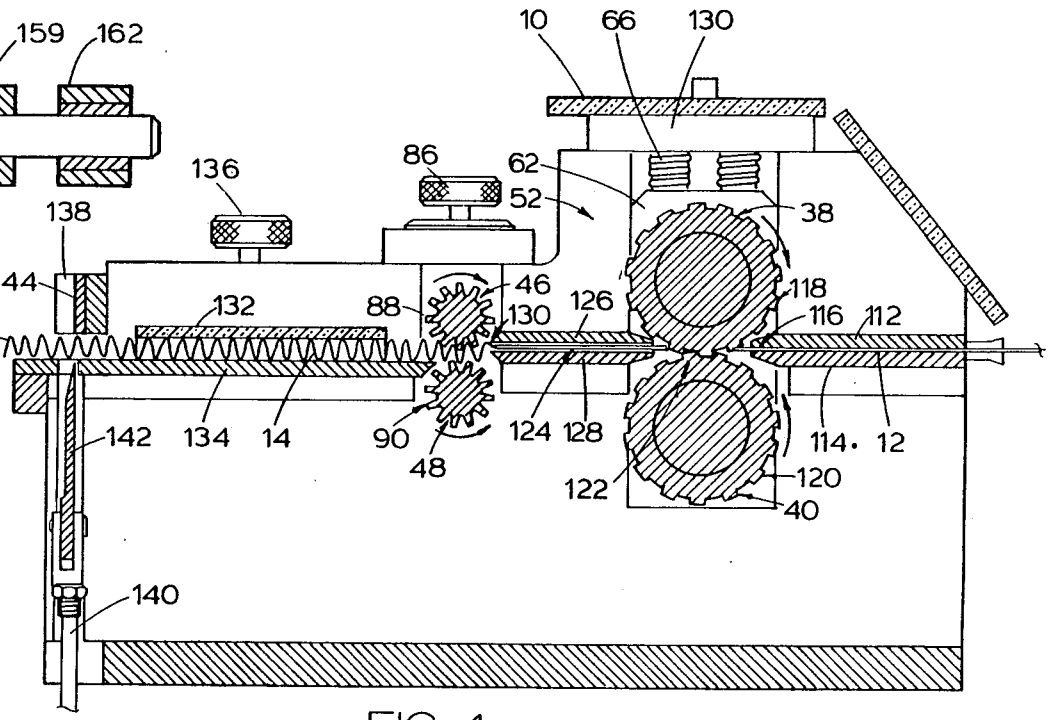
FIG. 4 is a view along the lines 4—4 of FIG. 1.

After the strip as corrugated passes out the counter rotating dies 46 and 48 it is removed from the apparatus at the chute exit 100. The strip moves along the flat sloped table surface 102 for removal and subsequent use or storage The drive mechanism for the apparatus 10 includes an electrically powered motor 104. It is of course appreciated that electric motors are preferred however there are a variety of other forms of rotary power available which could be used in conjunction with the apparatus 10. The output of the electric motor 104 is input to a drive train 106 which has in turn an output to the transmission gear system 98. A hand operated lever 105 is provided to shift the drive train 106 between neutral and drive positions to avoid constantly turning the motor on and off. Above the electric motor 104 is a visual read out system 108 which indicates to the operator a variety of varying parameters in the operation of the apparatus 10. The system includes a linear counting mechanism which extracts from the rate of rotation of the apparatus 10 the length of cooling fin being produced A read out such as on screen 110 indicates instantaneously the length of strip being corrugated. System 108 may include a suitable control mechanism to actuate a device to sever the moving length of corrugated strip so as to provide individual corrugated strips of material of essentially equal length With reference to FIGS. 2, 3 and 4 further details of the apparatus drive system for the forming dies and corrugating dies will be discussed. The strip 12 is fed between guide plates 112 and 114 and into the nip area 116 of the opposing counter rotating forming dies 38 and 40. The forming die 38 has on its exterior a plurality of cutting edges 118. Similarly the forming die 40 has outwardly projecting cutting edges 120. In accordance with standard practice, the cutting edges 118 and 120 of the opposing dies mesh in the region generally designated 122 to pierce the strip 12 in forming the louvre impression arrangement 42. The strip portion 124 containing the louvered impression region, passes outwardly of the opposing dies 38 and 40 between guide plates 126 and 128. As shown in FIG. 4, the upper die 38 which is mounted in slide block 62 has two springs generally designated 66 beneath plate 130. The plate is tightened downwardly onto the frame 52 to compress the spring 68 to maintain engagement between the opposing dies 38 and 40. The springs will however, provide for some upward movement in the die 38 away from the die 40 should an obstruction or the like enter or jam between the dies to thereby avoid damage to the projections 118 and 120. In addition the spring 66 can compensate for major variations in the hardness of the strip 12.

The corrugating dies 46 and 48 counter rotate and have fed to their entrance region 130 the stamped strip 124. Die 46 has radially extending teeth 88 whereas die 48 has radially extending teeth 90. The teeth mesh in the opposing region at entrance 130 to a slight degree where their rotation relative to each other is synchronized to induce folding in the strip 124 in the blank regions 44 between adjacent impressions 42. As the strip exits from between the opposing plates 126 and 128, it is by a virtue of the tangential force exerted on the strip by the opposing dies 38 and 40 forced towards the corrugating dies 46 and 48. This, in conjunction with dies 46 and 48, induces a folding action in the strip 124 in the blank regions 44. The corrugated strip 14 as it emerges from the corrugating dies 46 and 48 passes between plates 132 and 134 where the corrugated strip is compressed slightly to cause a bunching up of the corrugations The extent of compression is determined by the adjustment knob 136 which is on each side of the apparatus 10. As previously noted the control system 108 includes a device for recording the length of corrugated material which has been formed When a desired length has passed beyond the shearing die 138, the piston rod 140 is actuated to raise quickly the shearing knife 142 to sever the desired length 14A of corrugated strip material from the continuous strip 14. Shearing knife 142 passes along die edge 144 to produce a clean cut in forming the desired length of fin material 14A.

As can be appreciated from FIG. 4, the timing of when the teeth 88 and 90 of corrugating dies 46 and 48 intermesh in forming the folds 44A, B, C ... in region 44 is critical with respect to where the die ridges 118 and 120 are formed between the impressions 42 in the strip 12. It is apparent however, that for any one set up in the timing of the rotation of the dies 46 and 48 relative to the dies 38 and 40, variations in the characteristics of the supply material 12 will result in the phase relationship in the rotation of the corrugating dies to the forming dies being no longer be acceptable and hence adjustment is required in the relative rotation of the two sets of dies.

According to this invention, a simple, readily adjustable system is provided which allows relative adjustment of the phase relationship of the rotation of the corrugating dies 46 and 48 relative to the forming dies 38 and 40. This is accomplished by a clutch mechanism 153 which is part of the transmission 98. The output 148 from the converter 106 is into gear 150. Gear 150 engages gears 152 and 154. Gear 152 is mounted on shaft 70 and extends through gear 74 which is also keyed to shaft 70. Gear 74 engages corresponding gear 72 which is keyed to shaft 68. As already explained with respect to FIG. 1, gears 72 and 74 drive the forming dies 38 and 40 which are also secured to the shafts 68 and 70. As shown in FIG. 3, the output of the gear box 106 to shaft 148 is in a clockwise direction so as to drive the gears 72 and 74 in the strip feed direction. Gear 150 as it engages gear 154 rotates the shaft 156 in the counterclockwise direction A coupling 146 couples shaft 156 to shaft 158 to which the folding die 48 is secured. Hence the lower folding die is rotated in the correct feed direction. The lower folding die 48 is geared to the upper folding die 46 by way of interengaging gears 92 at each end of the dies. The lower folding die 48 has a shaft portion extending outwardly of the frame 52 with a manually graspable adjustment knob 160 secured thereto. In normal operation, looking from the view of FIG. 3 the knob 160 is rotated in a counterclockwise direction. To support gear 154 with shaft 156 extending therethrough a housing including a bearing 162 is provided as mounted on the base plate 18.

The clutch 153 is a slip clutch system. Hence when gear 154 is rotated in the counterclockwise direction, the clutch mechanism engages with sufficient force to drive shaft 156-158 and control knob 160 in the same counterclockwise direction. According to this embodiment, the clutch mechanism 153 comprises two slip clutch devices 155 and 157. Each slip clutch is the same and comprises a casing 164 within which a plurality of cylindrical rollers 168 are located The rollers 168 in combination with the casing 164 engage when the gear 154 is rotated in the counter-clockwise direction. Although the rollers engage the casings with sufficient force (e.g. frictional force) to rotate shaft 156 during normal operation of the corrugating dies, such engagement force can be overcome by manually advancing the shaft in a counter-clockwise direction which is permitted by the rollers slipping against the casing. The specially designed clutches engage with sufficient force to drive the corrugating dies, but can be overriden by a manual force to advance the dies and hence change the phase relationships of the corrugating dies to the forming dies The casing 164 of the clutches are force fitted into the bore of the gear 154 to interengage permanently each casing 164 with the gear 154. To maintain the gear 154 in position on the shaft 156 so as to engage gear 150, the collar 159 and coupling 146 may be laterally adjusted to abut the clutches 155 and 157 to locate the gear 154. The interaction of the rollers with the casing 164 is such that there is an almost instantaneous response by the clutch. When rotation in gear 154 commences, shaft 156 is directly coupled thereto to rotate immediately in the same direction. When the desired phase relationship of the corrugating dies 46 and 48 is attained with respect to forming dies 38 and 40 that phase relationship does not change because of the one way action of the clutch.

The manual adjustment in relative terms for the radial positioning of the corrugating dies 46 and 48 is accomplished by manually rotating the knob 160 in the counter-clockwise direction i.e. in the same direction as the normal direction of rotation of shaft 156 by overriding the clutches. In this direction the rollers 168 will release from the casing 164 and rotate to permit rotation of the shaft 156 relative to gear 154. Such rotation of the knob 160 may be done either when the apparatus is still or is operating. Preferably such adjustments are made while the machine is operating at reduced speeds so that the operator can visually examine the quality of the strip as it emerges from the folding dies and continue to make fine adjustments in the relative phase relationship of the corrugating dies to the forming dies until the correct setting is achieved to provide the desired quality of product in forming zig-zag folds of the type shown in FIG. 6.

The clutch mechanism 153 therefore provides an infinite adjustment in the relative rotational positioning of the folding dies 46 and 48 to the forming dies 38 and 40. As the characteristics of the supply strip 12 varies, the operator can detect changes in the quality of the fins and make adjustments at reduced speeds of operation by rotating the knob 160 to change the phase relationship of the folding dies 46 and 48 relative to the forming dies 38 and 40 and move the functioning of the apparatus towards the production of the desired quality of product. Should the material characteristics change again further adjustments can be made during operation An entire supply roll of material can be handled with this apparatus without any down time for manual adjustments. Furthermore, due to the infinite adjustability of the clutch system, immediate variations can be made during operation of the apparatus to provide the necessary fine tuning and maintenance of the desired quality of radiator fin product.

Figure 5:
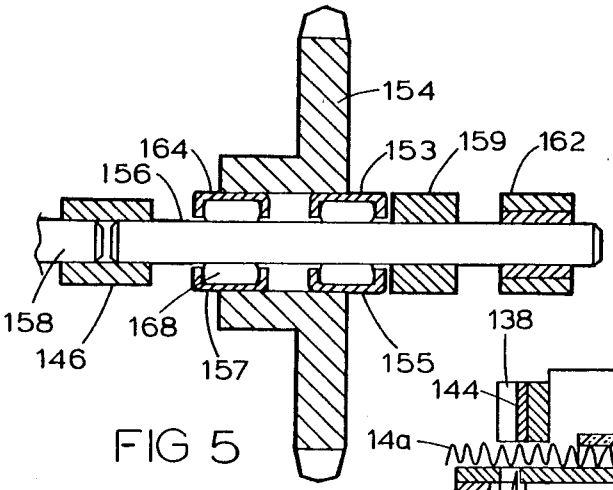
FIG. 5 is a view through a section of the clutch of FIG. 2.

The transmission device as noted in FIG. 3 for transmitting rotary power of the gear box 106 to the forming dies and the folding dies may be of the gear type construction. It is appreciated however, that other transmission devices are available which may be readily used in place of the gear construction, where a type of slip clutch is incorporated into the transmission to accomplish the features with respect to adjusting the relative radial position of the folding dies relative to the forming dies The transmission has the necessary effective gear ratio which synchronizes the rotary movement of the folding dies relative to the forming dies. It is appreciated that a variety of one way slip clutches are available such as those shown in FIG. 5. The unit of FIG. 5 may be purchased from Winfred M. Berg Inc. of East Rockway, N.Y. under the trade mark SURE-LOCK roller clutches. It is appreciated that the apparatus 10 may be used for any type of strip metal folding It is not necessarily limited to the formation of radiator fins, but may be used to form folded strips for use in a variety of other heat transfer devices, building materials and the like.

Although preferred embodiments of this invention have been described herein in detail, it will be understood by those skilled in the art that variations may be made thereto without departing from the spirit of the invention or the scope of the appended claims.

THE EMBODIMENTS OF THE INVENTION IN WHICH AN EXCLUSIVE PROPERTY OR PRIVILEGE IS CLAIMED ARE DEFINED AS FOLLOWS:

1. In an apparatus for corrugating a length of malleable metallic strip into a corrugated strip of a series of zig-zag folds, said apparatus including opposing counter-rotating forming dies for forming a series of equally spaced-apart impressions in such strip, means for corrugating such strip with the impressions formed therein by folding such strip intermediate adjacent impressions in alternating opposing folds to form a series of zig-zag folds, said corrugating means comprising opposing counter rotating corrugating dies having opposing radially extending teeth, means for driving said counter-rotating forming dies in synchronism with each other and means for driving said counter-rotating corrugating dies in synchronism with each other, means for rotating said forming die drive means and means for transmitting rotary motion from said forming die drive means to said corrugating drive means, said transmission means having an effective gear ratio to synchronize rotation of said corrugating dies in phase with said forming dies to induce zig-zag folding in such strip of metal between the formed adjacent impressions, said transmission means including means for adjusting phase relationship of the rotation of said corrugating dies with rotation of said forming dies, the improvement wherein said means for adjusting phase relationship comprises:

a slip clutch for selectively disengaging said transmission means while said rotating means continues to rotate said forming die drive means to adjust the phase relationship of said counter-rotating corrugating dies relative to said counter-rotating forming dies, said slip clutch being continuously engaged with sufficient drive force to drive said counter-rotating corrugating dies in a metal strip feed direction, manually operable means for overcoming the drive force to advance rotation of said corrugating die drive means in the feed direction, as the clutch slips by engaging the manually operable means, the phase relationship of the rotation of said counter-rotating corrugating dies relative to the rotation of said counter-rotating forming dies is adjusted thereby on an infinite basis.

2. In an apparatus of claim 1, said transmission means including a drive shaft secured to said corrugating die drive means, said manually operable means being a manually graspable knob directly connected to said corrugating die drive means to permit adjustment of said phase relationship while said apparatus is in operation.

3. In an apparatus of claim 2, said transmission means including a gear which is coupled to said drive shaft by said clutch.

4. In an apparatus of claim 3, said clutch having a roller bearing arrangement which locks up to couple directly said drive shaft to said gear as said transmission means rotates said drive shaft, said roller bearing arrangement rotating as said knob is rotated in said feed direction as applied force overrides engagement force of said clutch.

5. In an apparatus of claim 4, said forming dies forming an impression of a series of slots along the width of such metal strip, said slots being all of equal length and all extending in the length direction of such metal strip.

6. In an apparatus of claim 5 as adapted to corrugate a length of copper alloy strip to form a radiator cooling fin arrangement, said forming dies forming a plurality of slots for each impression in the form of louvers.

* * * * *